United States Patent [19]

Jones et al.

[11] Patent Number: 5,012,398

[45] Date of Patent: Apr. 30, 1991

[54] LIGHT BAR LEVELER

[75] Inventors: Robert D. Jones, Oskaloosa; David M. Demeyer, Colfax, both of Iowa

[73] Assignee: Musco Corp., Oskaloosa, Iowa

[21] Appl. No.: 466,916

[22] Filed: Jan. 18, 1990

[51] Int. Cl.[5] ..... F21V 21/14

[52] U.S. Cl. ..... 362/250; 362/386; 362/401; 362/403

[58] Field of Search ..... 362/233, 250, 285, 286, 362/386, 391, 403, 401

[56] References Cited

U.S. PATENT DOCUMENTS

| | | | |
|---|---|---|---|
| 2,609,170 | 9/1952 | Farrington et al. | 362/386 X |
| 3,514,586 | 5/1970 | Kuebler | 362/250 |
| 4,358,817 | 11/1982 | Bielemeier | 362/403 X |
| 4,450,507 | 5/1984 | Gordin | 362/61 |

*Primary Examiner*—Stephen F. Husar

*Attorney, Agent, or Firm*—Zarley, McKee, Thomte, Voorhees, & Sease

[57] ABSTRACT

A leveling device for leveling the orientation of a suspended light bar, beam, or cross-arm to which is mounted one or more light fixtures includes a bracket secured to the light bar and having an outwardly extending end. An adjustment cable is attached at opposite ends to the light bar and the outwardly extended end of the bracket, and passes through a pulley which is attached to the end of a suspension cable, which suspends the light bar and light fixtures from an elevated structure. An actuator member is attached between the pulley and the extended end of the bracket. Lengthening or retracting of the actuator member causes relational movement of the extended end of the bracket with respect to the pulley which in turn allows the adjustment cable to move through the pulley to shift the suspended support member and vertically align the suspension cable with the center of gravity of the suspended light bar to maintain the light bar in a level position counteracting leveling force against any opposite rotational movement of the light bar.

5 Claims, 4 Drawing Sheets

LIGHT BAR LEVELER

BACKGROUND OF THE INVENTION a. Field of the Invention

The present invention relates to a light bar leveler, and in particular, a leveling means for leveling a freely suspended light bar to which is mounted one or more light fixtures.

b. Problems in the Art

Large lighting fixtures generally include a large, bulky reflector means for capturing and redirecting light to a target area. The reflectors generally surround the bulb or lamp, which in turn is mounted in a socket means or bulb cone to which electrical power is supplied. The socket, in turn, is generally mounted to a support member. Many times the socket member is adjustable with regard to the support member to allow different aiming orientations of the light fixture.

One type of support member for multiple large lighting fixtures is a rigid elongated bar, beam or cross-arm which can be horizontally secured to a vertical light pole or the like or otherwise suspended. A common term for the bar, beam or cross-arm which supports multiple lights fixtures is a light bar. It is generally a rectangular-in-cross-section hollow tube, with closed ends. Conventional light bars are generally on the order of ten feet long allowing usually from one to four light fixtures to be secured along the light bar at spaced-apart positions.

In typical use, the light bar is suspended and the light fixtures are all angularly oriented or tilted downwardly and outwardly on the same side of the bar towards a target area. In other words, much of each light fixture is positioned on the same side of a vertical plane extending through the longitudinal axis of the bar. This causes the center of gravity of the light bar with attached light fixtures to move off of the light bar, and as a result, produces torsional force tending to urge the horizontal bar to be rotated around its longitudinal axis. If the light bar is freely suspended, such as with vertical cables, such rotation would occur, causing the light bar to roll forward in the direction of the outer ends of the outwardly extending lamps, and thus move the lamps away from their intended aiming. The light bar would then not be "level", as that term will generally be use herein.

This is normally not a problem with light bars which are rigidly attached to a suspending pole, beam, derrick or other suspension means. In these cases, because the cross-arm or light bar is rigid, and is in turn rigidly attached to a light pole or the like, any offset of center of gravity or imbalance cannot cause the bar to rotate or move in any direction. Rigid attachment prevents the torsional force from causing rotation of the light bar around its longitudinal axis.

However, there are many applications where large wide-scale light fixtures are desirable, but sturdy and rigid light poles are not desired or are not available. In many of these types of cases, the light bars and fixtures are or need to be suspended from some elevated structural support such as a ceiling beam or a boom. For example, the light bar could be suspended by cables, wires, or the like from the elevated structural support.

Although this presents an economical and relatively easy method for suspending large lighting fixtures, the imbalance of the lighting fixtures with respect to the light bar support member makes it difficult, or impossible, to keep the light bar level, or in a consistent, fixed aiming position. Although the cables can be fairly accurately and easily adjusted and maintained to keep the bar level in the sense that opposite ends of the bar are at an equal height from the floor, it is difficult to keep the bar level in the sense that it will not rotate or roll forward around its longitudinal axis towards the center of gravity, which is the leveling problem addressed here.

Essentially the problem to be solved is that the center of gravity of the light fixture is generally extended away from the support member when the light fixtures are aimed outwardly in the same general direction. The support member is somewhat unstable because it is being suspended by cables or the like. Thus, the offset center of gravity of the one or more light fixtures would cause the support member to rotate around its longitudinal axis. Additionally, this problem would not allow the light fixtures to be easily or accurately pre-aimed before the light bar is suspended, because the exact amount of rotation of the bar would not easily or reliably be known until suspended to its final position. Still further, if any one of the light fixtures needed to be re-aligned, it could very well affect the aiming of the other fixtures because of a rotation of the light bar on a change of a center of gravity.

It would be preferred, of course, if the cable-suspended support member could be adjustably and automatically held in what will be referred to as a "reference" or "level position" so that any offset center of gravity urging or causing the support member to rotate around its longitudinal axis could be corrected or compensated. In other words, it is desired that the support member be consistently held in a position similar to it being rigidly secured to a vertical support pole or the like. While leveling of the support member could be attempted by adding weights or other load leveling apparatus to the support member to counterbalance the light fixtures, the problem is not completely alleviated, especially if the position of the light fixtures with respect to the support member is adjusted or altered. This would also add considerable weight to the arrangement, be cumbersome, and inefficient.

Additionally, in some situations, the lighting fixtures are articulately mounted to the light bar. Their angular and directional orientation can thus be changed by manipulating a joint means for each fixture. See, for example, U.S. Pat. No. 4,450,507 to Gordin, issued May 22, 1984, entitled Composite Photometric Method. Thus, although a light bar might be balanced by counterweights or the like with the light fixtures in one position, any adjustment of any light fixture would generally result in some change in the center of gravity or balance which would unlevel the light bar. If this occurred, there would be no set frame of reference by which the aiming of the light fixtures could be accomplished. Also, adjustment of less than all of the fixtures would bring the remaining fixtures out of their intended aiming orientation.

Still further, there are means and methods by which the light fixtures can be remotely adjusted according to desire. For example, in U.S. Pat. No. 4,712,167, to Gordin and Drost, entitled "Remote Control, Moveable Lighting System," issued Dec. 8, 1987, there is disclosed a wide-scale lighting fixture having actuators associated with the fixture which respond to remote control from a radio transmitter or the like. The fixture can be panned or tilted, according to desire. This patent is incorporated by reference herein. Obviously, if the light bar with these adjustable multiple light fixtures were suspended from cables, the light bar may be generally level, that is, its top surface horizontal, if all fixtures were pointed directly downward from the bottom of the light bar. However, if any fixture were angularly oriented away from pointing directly downward, the center of gravity of the light bar would be altered and the light bar would rotate around its longitudinal axis. Remotely controlled light fixtures allow easy and flexible adjustment of the fixtures in a number of directions. Each adjustment would alter the bar's center of gravity and would therefore unlevel the light bar.

It would therefore be desirable to have a leveling means which could be used to maintain the light bar in a certain orientation (called "level position"), regardless of the orientation or aiming directions of the light fixtures (or any other structure) on the light bar, or any change in orientation or aiming direction of any light fixture on the light bar. The bar would be adjusted to always stay in reference or level position, even if the fixtures are adjusted in a manner to urge the bar to rotate around its longitudinal axis.

Furthermore, it is inefficient and cumbersome to manually level the light bar each time it is suspended or any fixture's orientation is changed. Because large, wide scale lighting fixtures most times must be suspended from very high positions, in many cases it is difficult or even impractical for leveling to be manually accomplished. It would therefore be desirable to have a leveling means which leveled the light bar when suspended. It would also be desirable to have a leveling means which could, if desired, automatically level the light bar when suspended.

It is therefore a principal object of the present invention to provide a leveling means for suspended light bars with lighting fixtures which solves or overcomes the problems and deficiencies in the art.

Another object of the present invention is to provide a means as above described which allows for leveling and maintaining the reference position of the light bar holding the light fixtures, with respect to rotational around its longitudinal axis, regardless of the orientation of the light fixtures, or the imbalance of the light fixtures or any other attachments or structure with regard to the light bar.

A further object of the present invention is to provide a means as above described which can level the light bar for the light fixtures, regardless of how many light fixtures are utilized.

A further object of the present invention is to provide a means as above described, which can automatically level the light bar supporting the light fixtures.

A further object of the present invention is to provide a means as above described which is non-complex, reliable, durable, and economical.

These and other objects, features, and advantages of the present invention will become more apparent with reference to the accompanying specification and claims.

SUMMARY OF THE INVENTION

The present invention includes a leveling means for adjusting and leveling the orientation of a suspended light bar to which is mounted one or more light fixtures with respect to rotation of the bar around its longitudinal axis. It is to be understood that the terms "level" and "leveling", as generally used herein, refer to maintaining the reference position of the bar supporting one or more light fixtures with respect to rotation of the bar around its longitudinal axis. It does not refer to maintaining the bar horizontally level from end to end, unless specifically stated.

The leveling means includes one or more (usually two) leveling actuator assemblies. Each leveling actuator assembly includes a bracket means having one end attached to the light bar, and a second outer end extending generally transversely and outwardly from the longitudinal axis of the support means. The second outer end of each actuator assembly extends in the same general direction from the light bar.

A cable is connected at an attached point on either the light bar or on the bracket near the light bar. This cable passes upwardly and over a pulley means and extends to connection at the outer or extended end of the bracket at its other end. As a result, this cable basically suspends the light bar and lighting fixture or fixtures from the pulley means.

The pulley of each actuator assembly is then attached to the lower end of a cable, wire, or other means used to suspend the actuator assemblies, support member and the light fixtures from a structural support, such as a crane or ceiling beam.

An actuator device is attached at opposite ends between the pulley means and to or near the extended end of the bracket means, respectively. The actuator means is extendable and retractable. By operating the actuator means, the distance between the pulley means and the extended end of the bracket can be adjusted. This causes the cable to move through the pulley means. Operation of the actuator assemblies serves to counteract any offset of center of gravity from the light bar. By being able to extend or retract the actuator devices, any offset of the center of gravity caused by the light fixtures can be compensated by the horizontal adjustment of the bracket means with respect to the pulley means, so that the pulley means is always directly above the brackets in a vertical plane parallel to a vertical plane through the longitudinal axis of the light bar end through the center of gravity (even if offset from the bar) of the combination of the bar and light fixtures.

The actuator devices extend outwardly from the same lateral side of the light bar. The cable and pulley means allows adjustment to be made smoothly and with a minimum amount of stress on the components of the system. In essence, the leveling means automatically horizontally shifts the light bar and attached light fixtures relative to the suspending cable(s) so that the suspending cables always are in a vertical plane parallel to a vertical plane through the longitudinal axis of the bar through the center of gravity of the entire assembly.

Generally, there are at least two actuator assemblies for a light bar. Thus, in this situation the light bar is suspended by two cables. The actuator assemblies can be operated in unison to level the light bar.

A detector means can be utilized to automatically monitor whether the support member is in a level position and instruct the actuators to adjust. If the support member is not in a level position, the detector means can send a signal to the actuator devices to either extend or retract until it detects a level position. The leveling means can therefore be automatic, and constantly maintains the level position of the light bar.

DETAILED DESCRIPTION OF THE PREFERRED EMBODIMENT

Figures 1, 2, 3:
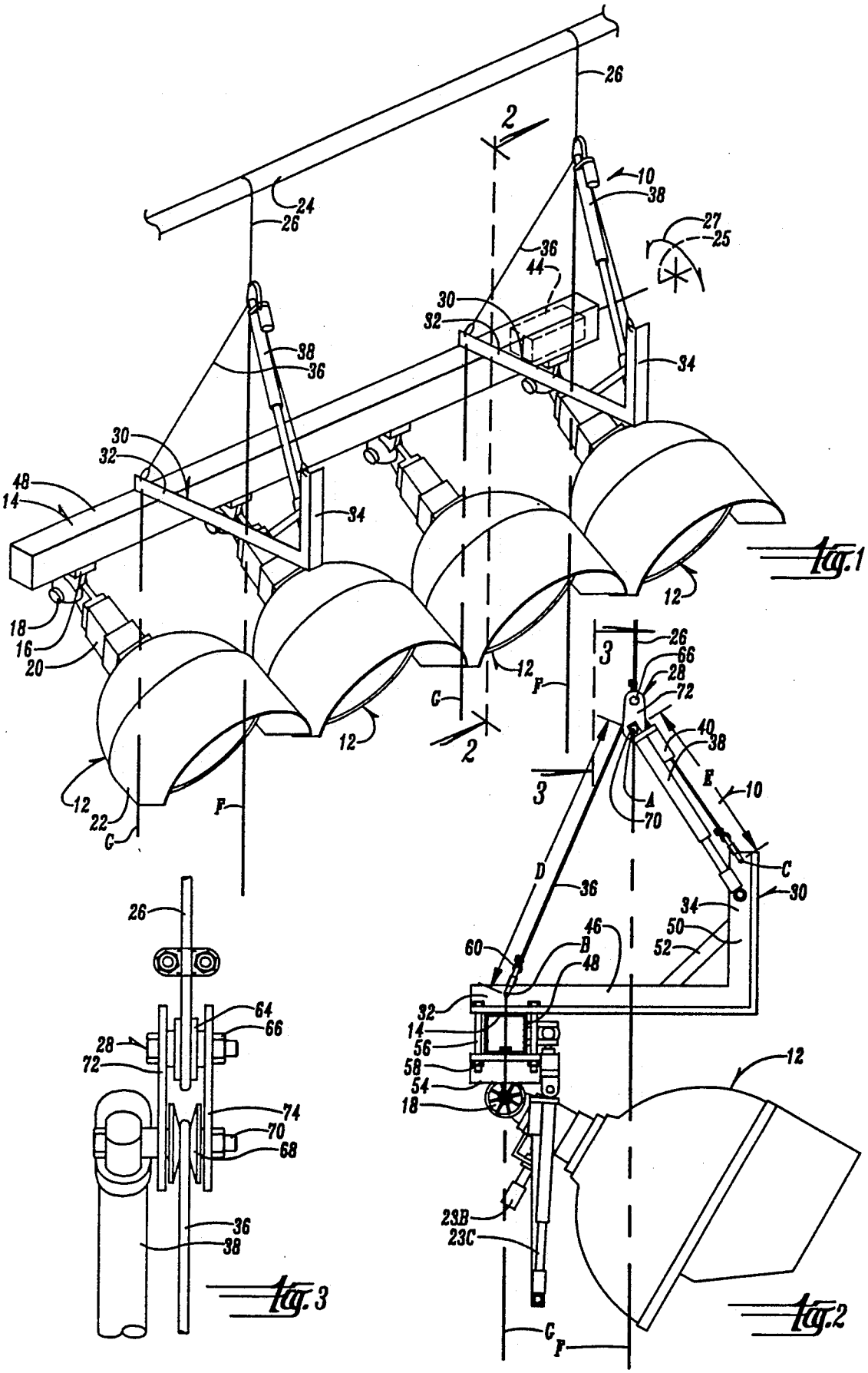
FIG. 1 is a perspective view of a preferred embodiment of the invention showing suspension of a light bar from an elevated structural support with light fixtures angularly oriented in similar directions.
FIG. 2 is a side partial sectional view taken along lines 2—2 of FIG. 1.
FIG. 3 is a partial view taken along lines 3—3 of FIG. 2.

With reference to the drawings, a preferred embodiment of the present invention will now be described. Like reference numerals in each of the drawings will refer to like parts, unless otherwise indicated.

FIG. 1 shows a light bar and leveling assembly 10 including four lighting fixtures or luminaire assembly units 12 mounted to cross-beam, support member, or light bar 14 at spaced apart positions. Each lighting fixture 12 includes a mounting base 16 which is secured by bolts or by other means known within the art to the underside of light bar 14. An adjustable elbow 18 allows adjustable vertical tilting of lamp socket or bulb cone 20, to which are mounted the lamp bulbs (not shown) and reflector structures 22. It is o be understood that light fixtures 12 could also include structure allowing them to horizontally pivot or pan laterally with respect to one another. It is also to be understood that each light fixture 12 could include motorized actuators 23 which facilitate selective panning, tilting, and beam width adjustment for each lighting fixture 12 according to remotely generated instructions. Such controllable remote movement can be as is disclosed in U.S. Pat. No. 4,712,167, referenced previously, or as disclosed in U.S. Pat. No. 4,729,077, by Gordin and Drost, entitled "Variable Beam Width Lighting Device," issued Mar. 29, 1988, and also incorporated by reference herein. Such structures allow each lighting fixture 12 to be articulatable for a variety of aiming directions, orientations, and beam widths according to desire, but are not shown in FIG. 1.

FIG. 1 shows lighting fixtures 12 in a typical position for directing light downwardly at an angle to a target area. It can be seen that lighting fixtures 12 are tilted upwardly from vertical which can create an unbalanced center of gravity with respect to light bar 14. The position of light fixtures 12 in FIG. 1 necessarily moves the center of gravity for the entire apparatus 10 away from the vertical plane through the longitudinal axis 25 of light bar 14 and outwardly in the direction of fixtures 12. This tends to urge light bar 14 to rotate around axis 25 towards the center of gravity (in the direction of arrow 27 in FIG. 1). This would unlevel light bar 14 in the sense used herein.

The manner in which light bar 14 and lighting fixtures 12 are suspended and kept in a level or reference position shall now be described. In the preferred embodiment, two identical combination structures, referred to as actuator assemblies, are used to accomplish this (see FIG. 1). For purposes of simplicity, only one shall be described, with particular reference to both FIGS. 1 and 2.

A suspension cable 26 is attached at its upper end to an elevated support structure 24, and at its lower end to a connection on a pulley member 28 of the actuator assembly. A bracket 30 is attached at one end 32 to light bar 14. Bracket 30 then extends in an L-shape outwardly and upwardly to an outer or extended end 34. An adjustment cable 36 is attached at one end to extended end 34 of bracket 30, and at its opposite end to end 32 of bracket 30. Adjustment cable 36 also passes through a rotatable pulley in pulley member 28. Adjustment cable 36 and pulley member 28 therefore basically bear most of the weight of brackets 30, light bar 14, and fixtures 12.

An actuator member or device 38 is mounted between pulley member 28 and extended end 34 of bracket 30. Actuator member 38 is extendable and retractable by operation of servo motor 40. By extension or retraction of actuator member 38, extended end 34 of bracket 30 is moved towards or away from pulley member 28. This in turn, causes movement of adjustment cable 36 through pulley member 28. This allows force to be exerted to counter the rotational torsion created by the light fixtures 12 offsetting the center of gravity of light bar 14, and allows leveling adjustment for light bar 14. The countering force provided essentially operates to keep light bar 14 from rotating about axis 25 as it is suspended, even if the light fixtures are adjusted and readjusted. It attempts to simulate the ability to keep the bar 14 in a fixed reference position as if it were rigidly secured to a light pole.

Depending on the required support, any number of brackets 30, and corresponding adjustment cables 36 and actuator members 38 can be positioned along light bar 14 and hung from pulley members 28 attached to the end of suspension cables 26. In the preferred embodiment, two identical sets of leveling apparatus or actuator assemblies are utilized at basically equidistant spaced apart locations from the center of along light bar 14 (see FIG. 1). It is to be noted that the actuator assemblies, including brackets 30 and actuator members 38, are positioned to extend in the direction, transversely from the longitudinal axis 25 of light bar 14, which the fixtures 12 are tilted, such as in FIGS. 1 and 2. As can be seen, operation of actuator members 38 compensates for the offset in center of gravity from the light bar to this same side of light bar 14 by contracting from a fully extended position to allow the pulley means 28 to be positioned above brackets 30 at an intermediate point along the length of brackets 30. Suspending cables 26 are therefore in the same vertical plane (parallel to a vertical plane through the longitudinal axis of light bar 14) as the center of gravity of the entire configuration. This balancing causes the portion of bracket 30 containing end 32 to be generally horizontal, which in turn maintains the top surface of light bar 14 horizontal or in its reference level position.

The partial contraction of actuator member 38, as shown in FIGS. 1 and 2 actually lengthens the portion of adjustment cables 36, as they exist between pulley members 28 and attachment to light bar 14. Because vertical suspended cables 26 are freely attached to connection on pulley members 28, the structure below that attachment point will seek to find its center of gravity. By lengthening adjustment cables 36 in this manner (by shortening actuator assemblies 38), the light bar and fixtures actually would shift laterally underneath suspension cables 26 to the point where the vertical plane through the center of gravity of the light bar 14 and fixtures 12 (and parallel to a vertical plane through the longitudinal axis of light bar 14) would generally include the vertical suspension cables 26. In other words, the points of attachment of cables 26 to the actuator assemblies (at pulley means 28) would always be maintained over the center of gravity of light bar 14 and fixtures 12 and in the same vertical plane as previously described.

FIG. 1 also depicts a detector unit 44 which can be positioned inside or upon light bar 14. Detector unit 44 includes elements which detect whether light bar 14 is adjusted correctly or not. For example, detector unit 44 can be comprised of mercury switches which are precalibrated and positioned to indicate when the top and bottom surfaces of light bar 14 are generally horizontal (that is, generally parallel to a horizontal plane extending through the longitudinal axis 25 of light bar 14). If light bar 14 is not level in this sense, the mercury switches would indicate the misalignment and send a signal to actuator devices 38 which would operate until leveling was achieved. It is to be understood that the circuitry of detector unit 44 can sense whether light bar 14 is offset from level in either a forward or backward direction. Still further, detector 44 can then instruct actuator devices 38 to either extend or retract depending on which direction is needed to bring light bar 14 back to a level position.

FIG. 2 illustrates in more detail the exact structural relationship of the apparatus used for leveling. Bracket 30 is L-shaped, having a first portion 46 which extends generally in the same plane as the plane defined by the top surface 48 of light bar 14. The second portion 50 of bracket 30 then extends perpendicularly upward from first portion 46 of bracket 30, and can include a brace 52 between portions 46 and 50.

Brackets 30 are mounted to light bar 14 as follows. Plate 54 is positioned on the bottom side of light bar 14 opposite from top surface 48. Bolts 56 with nuts 58 are then extended through aligned apertures and tightened so that bracket 30 and plate 54 sandwich and grip light bar 14. Adjustment cable 36 can be connected to bracket 30 by eye members 60 which are slidably mounted in apertures in bracket 30.

In FIG. 2, it can be seen that a majority of the weight of light bar 14 and any light fixtures 12 is borne by adjustment cable 36 which rests within pulley member 28. The tension of adjustment cable 36 is then distributed to its opposite ends where it attaches to opposite ends of bracket 30. Some of the tension and weight is also borne by actuator members 38. It is to be understood that each actuator member 38, because of its rigidity, holds pulley 28 at a distance from extended end 34 of bracket 30.

For purposes of further discussion, in the Figures, the point where adjustment cable 36 passes through pulley 28 has been labeled "A", and the points of attachment of adjustment cable 36 to opposite ends of bracket 30 have been labeled "B" and "C". Furthermore, the length of adjustment cable 36 between points A and B has been labeled "D"; whereas, the length of adjustment cable 36 at any given instant between points A and C has been labeled "E". A vertical plane through the center of gravity is labeled "F", whereas vertical plane through the longitudinal axis of light bar 14 is labeled "G". Plane "F" is generally parallel to plane "G".

FIGS. 1 and 2 depict light bar 14 and light fixtures 12 in a leveled position with light fixtures 12 angled at an intermediate position between vertical and horizontal. It is noted that first portion 46 of bracket 30 is horizontal (as is top surface 48 of light bar 14), while second portion 50 of bracket 30 is vertical (as are the side walls of light bar 14). If, however, the offset weight of light fixtures 12 were to change by, for example, raising the position of one or more light fixtures 12, the plane "F" containing the center of gravity of the entire suspended system would move horizontally farther out and away from light bar 14 (to the right in FIG. 2), and light bar 14 would be urged to rotate in a clockwise direction (around its longitudinal axis 25) in the direction of the outer end of light fixtures 12. To correct this, actuator devices 38 would be retracted further to shorten distances "E" and lengthen distances "D" of adjustment cables 36. Adjustment cable 36 would then move within each pulley 68 and extend obliquely from pulley 68 on opposite sides to cause pulley 68 to align with the new parallel plane containing the rightward shifted center of gravity for light bar 14 and fixtures 12. The new vertical plane (parallel to the longitudinal axis 25 of the light bar 14) through the new center of gravity would be to the right of plane "F" in FIG. 2, and would be further from plane "G" than plane "F" in FIG. 2. This is because the changing of lengths of "E" and "D" causes the adjustment brackets 30 and light bar 14 and fixtures 12 to shift to the left in FIG. 2 to maintain the level position of light bar 14.

If, conversely, the center of gravity of light bar 14 and light fixtures 12 was brought closer in towards light bar 14 than is shown in FIG. 2 by lowering one or more light fixtures 12, this would tend to urge counterclockwise rotation of light bar 14. By extending actuator devices 38, point C is moved further from point A, which would in turn lengthen length E, and shorten length D. This action would shift adjustment cables 36 and pulleys 68 so that the light bar 14 would remain level, but the points attachment of suspending cables 26 with pulley means 28 would be maintained in a new vertical plane (parallel with plane "G") over the new center of gravity for light bar 14 and fixtures 12. In other words, light bar 14, fixtures 12, and brackets 30 would shift to the right in FIG. 2.

Figure 2A:
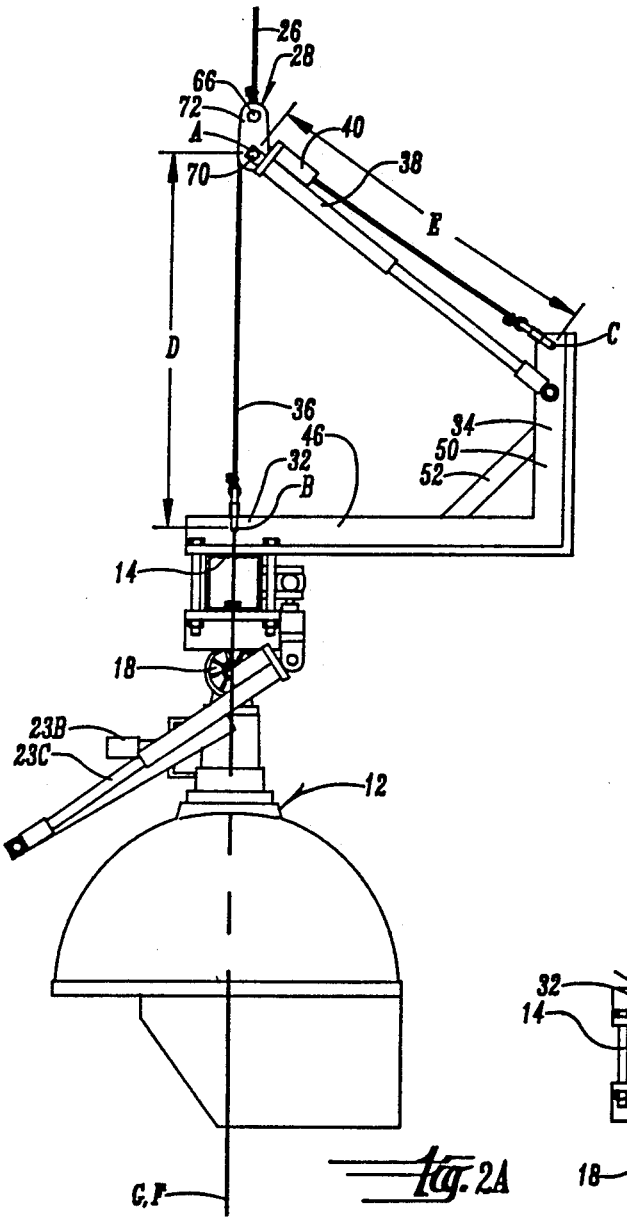
FIG. 2A is a side partial sectional view similar to FIG. 2, but showing the light fixtures directed vertically downward.
Figure 2B:
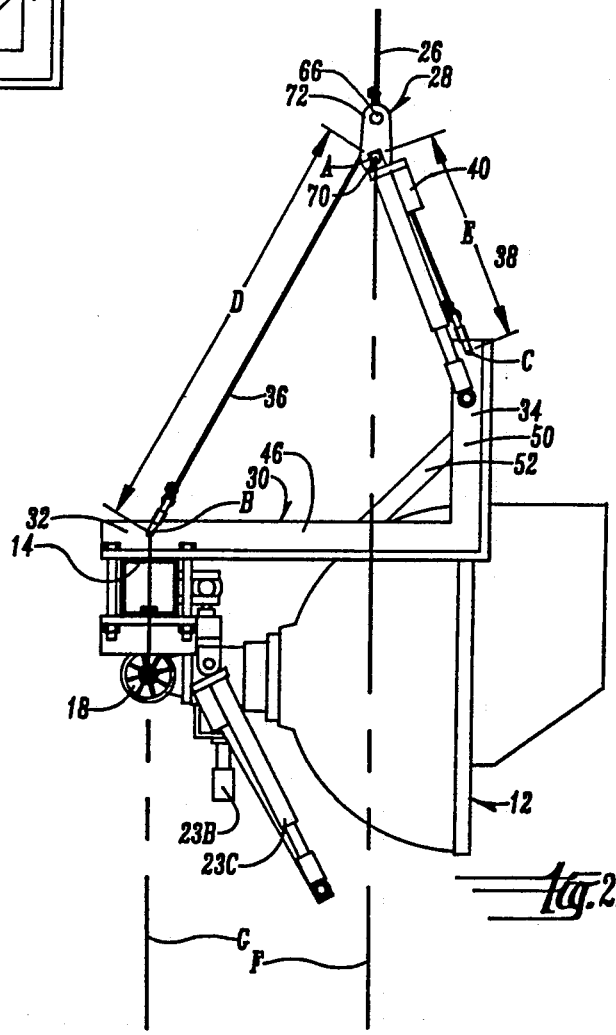
FIG. 2B is a side partial sectional view similar to FIGS. 2 and 2A, but showing the light fixtures directed horizontally outward.

To further clarify this operation, FIGS. 2A and 2B depict the opposite extremes for extension and retraction of actuator members 38. These extremes correspond to vertically downward and horizontally outward aiming directions for light fixtures 12.

FIG. 2A shows, in side elevational view similar to FIG. 2, what the combination would look like when light fixtures 12 are moved to be pointed directly downward. It can be seen that consistent with the invention, the point of attachment of suspending cables 26 with pulley means 28 is virtually directly over light bar 14 and generally in the vertical plane "F" through the center of gravity of light bar 14 and fixtures 12, which is approximately co-planar or substantially close to and parallel to vertical plane "G" through longitudinal axis 25 of bar 14. It is to be understood, of course, that when the center of gravity is discussed, it includes the weight of brackets 30, actuating members 38, and any other components below suspending cables 26.

FIG. 2A shows that in this case, the vertical lines representing the vertical plane intersecting the longitudinal axis of the light bar 14 (plane "G"), and the vertical plane through the center of gravity (plane "F") are generally closely parallel or coincident with each other and with suspension cables 26. In this case, actuator devices 38 would be fully extended and maintain light bar 14 in its level of reference position. It is to be understood that if the light fixtures were to be always pointed directly downwardly, no leveling devices would be needed, as planes "F" and "G" are generally coincident. However, it is when any fixture must be angularly tilted up from directly downward that leveling is needed.

By comparing FIGS. 2A and 2, it can be seen that in FIG. 2A, adjustment cable 36 at length D is almost vertical, and light bar 14 is aligned generally directly under supporting cable 26. FIG. 2, however, with the center of gravity shown by plane "F" shifted outwardly from vertical plane "G" through the longitudinal axis of light bar 14, and shows how length D of adjustment cable 36 is now angled or oblique to vertical and to suspending cable 26. It can be seen that light bar 14 has shifted to the left. It can, therefore, be seen how the system adjusts to change in center of gravity by shifting light bar 14 to maintain the connection point at pulley(s) 28 directly above the current center of gravity for everything below pulley(s) 28.

FIG. 2B shows the opposite extreme where light fixtures 12 are pointed almost directly horizontally. Actuator members 38 are fully contracted to allow pulleys 28 to be positioned in vertical plane "F" (relating to the center of gravity of the structure), which is spread apart to the farthest extent from vertical plane "G" (relating to the longitudinal axis of bar 14).

A comparison of FIGS. 2A, 2 and 2B reveals how light bar 14 is kept level by shifting the light bar underneath pulleys 28. The higher the light fixtures are tilted upwardly, the more actuator members 38 are contracted, and the more the entire assembly under pulleys 28 is shifted to the left, as shown in FIGS. 2A, 2 and 2B.

FIG. 3 shows more clearly the structure of pulley 28. Suspension cable 26 is looped under sleeve 64 positioned around mounting bolt 66. Adjustment cable 36 is looped over pulley wheel 68 which is rotatable around its mounting bolt 70. Opposite plates 72 and 74 hold sleeve and pulley wheel 68 in the spaced apart relation from one another.

Additionally, the upper end of each actuator device 38 is attachable on mounting bolt 70. It can therefore be seen that the entire weight of the leveling apparatus, light bar 14 and lighting fixtures 12 is borne by mounting bolts 66 and suspension cables 26. On the other hand, adjustment cables 36 can easily rotate or travel through pulley wheels 68 during the leveling process, and yet support a significant amount of weight.

Figure 4:
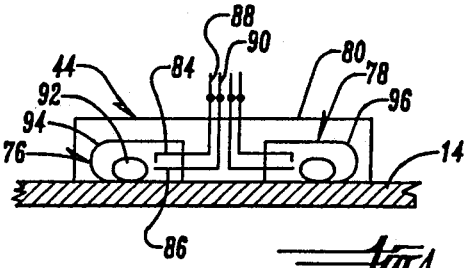
FIG. 4 is a schematic representation of opposed mercury switches which form a part of the preferred embodiment of the detection means of the invention.

FIG. 4 is a simplified schematic view of first and second mercury switches 76 and 78 and their positioning inside of one end of light bar 14. As shown in FIG. 1, it is preferred that these switches be positioned inside of light bar 14 to protect them from the environment and from any other damage. Switches 76 and 78 are conventional mercury switches which have a housing 80 containing sealed capsules 82. Electrodes 84 and 86 extend from inside of each capsule 82 outwardly to the exterior of housing 80. Wires 88 and 90 then extend to electrical circuitry.

A small quantity of mercury 92 is contained by each capsule 82. As is well known, mercury is highly electrically conductive. It is also liquid at normal environmental pressures and temperatures. Thus, mercury switch 76 or 78 functions by closing an electrical pathway through electrodes 84 and 86 when mercury 92 bridges electrodes 84 and 86 upon sufficient rotation of the light bar 14 around its longitudinal axis 25. When mercury 92 does not provide an electrical bridge between electrodes 84 and 86, the circuit for that particular switch is open.

FIG. 4 shows the opposed positioning of mercury switches 76 and 78. It is to be understood that switches 76 and 78 are mounted transversely across and on opposite sides of longitudinal axis 25 of bar 14. As can be seen in FIG. 4, switches 76 and 78 are positioned securely in light bar 14 so that when the top surface 48 of light bar 14 is horizontally level around its longitudinal axis 25, the mercury 92 in each switch 76 and 78 flows to nose 94 and 96 of each switch 76 and 78 and does not bridge electrodes 84 and 86. Thus, no electrical pathway is closed in either switch 76 or 78. Thus, these switches are normally open when light bar 14 is level. It can be seen, however, that if light bar 14 rotates in either direction around its longitudinal axis 25, it will cause mercury 92 in the raised side to flow and bridge the corresponding electrodes 84 and 86 in that particular switch 76 or 78 and close an electrical pathway. Thus, the closed electrical pathway can provide a signal that there is an unleveling, and can also inform which direction the unleveling is coming from. The signal will remain as long as the electrical pathway is closed by mercury 92. Once light bar 14 is brought back to level, the electrical pathway will be unbridged and any re-leveling by the invention will cease.

If the releveling process overcompensates and rotates it too far in the other direction, the opposite switch would close an electrical pathway, and inform the system that overcompensation has taken place, and cause appropriate adjustment to bring it to level. It can be seen that the sensitivity of the invention would be related to the sensitivity and positioning of mercury switches 76 and 78. It has also been found that it is easiest to install the detector means 44 in one end of light bar 14, however, mercury switches could be placed anywhere, either inside or outside, along the length of light bar 14.

Figure 5:
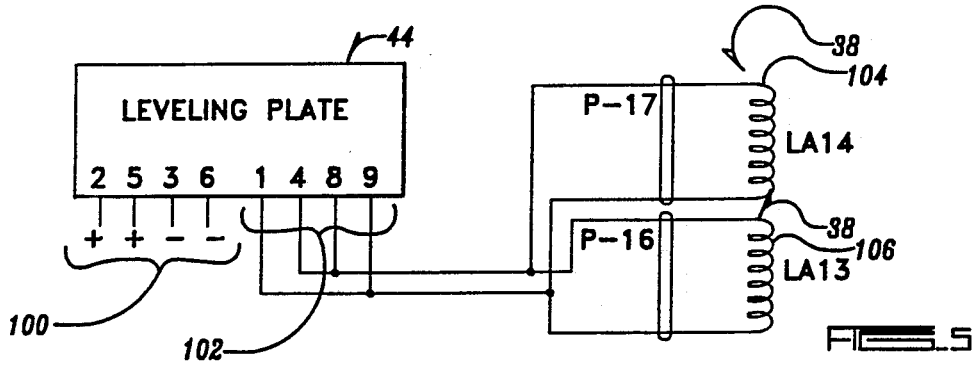
FIG. 5 is a diagrammatic representation of the electrical circuitry of the preferred embodiment of the invention.

FIG. 5 depicts schematically a simplified diagram of the components used for detection means 44. Leveling plate 98 depicts a base member or enclosure of rigid construction to which can be secured and positioned mercury switches 76 and 78 and the electrical circuitry which interprets the signals from switches 76 and 78. Leveling plate 98 can be made of a size which is insertable and securable into the interior of light bar 14. Also shown with respect to leveling plate 98 are electrical input ports 100 depicting the respective positive and negative current associated with each port. Further, there are shown the output ports 102 which send electrical power to linear actuators 38, which are schematically depicted by induction coils 104 and 106.

It is to be understood that actuators 38 either retract or extend on the basis of the direction of current flow through coils 104 and 106. In other words, the arms of actuators 38 are controlled by conventional servo motors 40 which rotate in one direction upon current flow in one direction through them; but rotate in an opposite direction when current is reversed through them. Therefore, the circuitry on leveling plate 98 determines which direction the servo motors 40 on actuator devices 38 should rotate to appropriately lengthen or retract the actuator arms, and then sends that appropriate current flow to coils 104 and 106. The actuators 38 then act in exactly the same manner to retract or extend to accomplish leveling.

Figure 6:
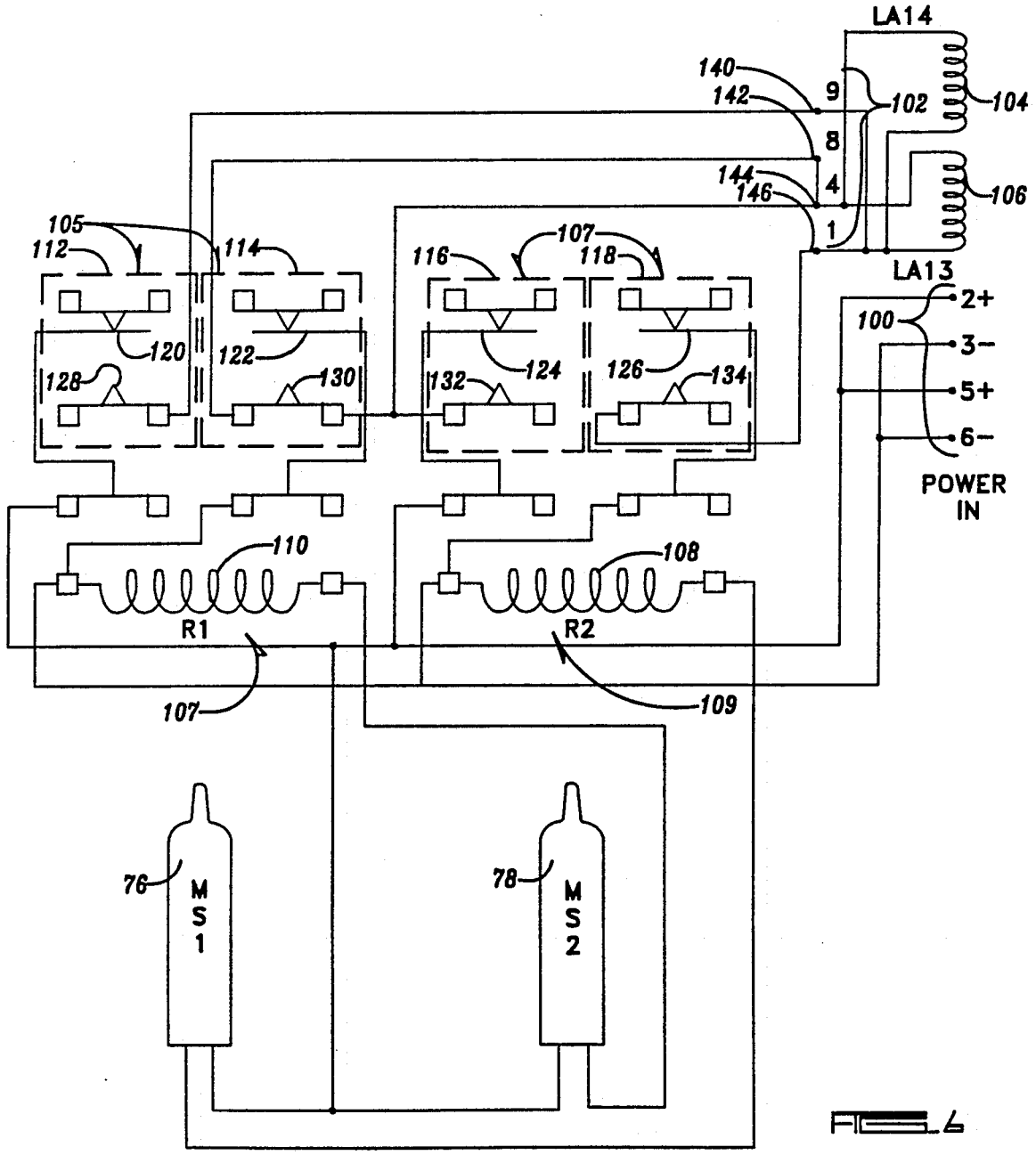
FIG. 6 is a detailed electrical schematic of part of the electrical circuitry of the preferred embodiment of the invention.

FIG. 6 discloses the preferred embodiment of the circuitry to accomplish the correct output to the servo motors 40 of actuator devices 38. As can be seen, mercury switches 76 and 78 are schematically depicted. Input and output ports 100 and 102 are also shown.

Figure 7:
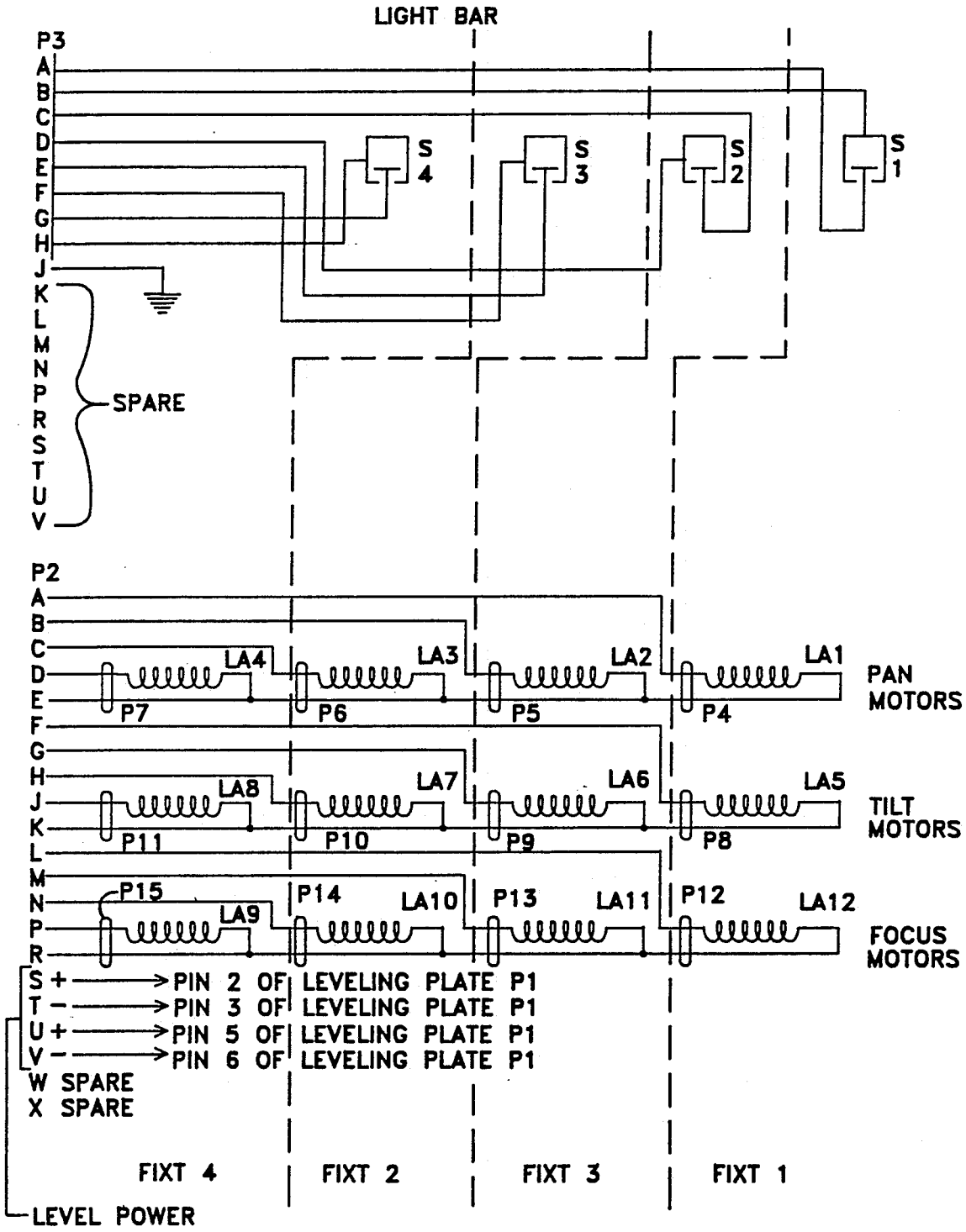
FIG. 7 is a detailed electrical schematic of the electrical circuitry of the remainder of the electrical circuitry of the preferred embodiment of the invention.

FIG. 7 is an electrical schematic showing how the circuitry of FIG. 6 can be interconnected to additional circuitry for an array of lighting fixtures such as is shown in FIG. 1.

It is to be understood that mercury switch 76 is mounted to leveling plate 98 in such a manner as to indicate a tilting motion of light bar 14 in a forward direction, whereas mercury switch 78 is mounted to plate 98 to indicate tilting of bar 14 in a reverse direction. A closing of either switch 76 or 78 creates a signal indicating an adjustment of the leveling mechanism is required. If both switches 76 and 78 are open, the system issues no signals and indicates that light bar 14 is in a sufficiently level position.

As shown in FIG. 6, the circuitry utilizes two relays 105 and 107 which include induction coils 108 and 110, which in turn each operate a pair of contacts. Induction coil 108 operates contacts 112 and 114 whereas induction coil 110 operates contacts 116 and 118.

As is well known in the art, relays 105 and 107 operate when electrical current passes through induction coils 108 and 110. If so, a magnetic field is created which would pull contact arms 120, 122, and/or 124, 126 from a normal biased open position, to a closed position, which can energize electrical pathways.

In the preferred embodiment of the present invention, FIGS. 5 and 6 show how relays 105 and 107 would be wired with respect to mercury switches 76 and 78 and with respect to induction coils 104 and 106 of linear actuators 38. As is well within the skill of those skilled in the art, it can be seen that when light bar 14 is tilted forwardly, mercury switch 76 would form an electrical pathway which would actuate induction coil 108. In turn, contact arms 124 and 126 would be pulled to position in contact with contact points 132 and 134. The electrical current flow would then be directed to output ports 142 and 144 at multi-pin connector output ports 102, through linear actuator coils 104 and 106, and back through output ports 140 and 146 to the negative side of the electrical power source.

As can be seen in FIGS. 5 and 6, this would lead to operation of the servo motors 40 of both linear actuators 38 in the same direction. Operation of actuators 38 would continue until mercury switch 76 no longer formed a current pathway, that is, until light bar 14 was sufficiently brought back to level. At that point the actuators would stop and bar 14 would be leveled.

On the other hand, if light bar 14 were tilted rearwardly, mercury switch 78 would form an electrical pathway. This electrical pathway would cause relay 107 to "fire"; wherein induction coil 110 would cause contact arms 120 and 122 to move down to contact points 128 and 130. The result would be that electrical current would flow out of output ports 140 and 146, through linear actuator coils 104 and 106, and back through ports 142 and 144 to the negative side of the electrical power source. This is exactly opposite of the current direction caused when mercury switch 76 was closed. Therefore, of course, servo motors 40 of linear actuators 38 would operate, but they would operate in a reverse direction, bringing the light bar back to level from the opposite direction.

It can therefore be seen that the preferred embodiment of the circuitry accomplishes the objectives of the invention. It is to be understood, however, that other circuitry could be used to meet these objectives.

It is also to be understood that the leveling system can be used to automatically operate when one of the lighting fixtures 12 has to be realigned, or is moved from an original position. When one of the lighting fixtures 12 is tilted up from a more downwardly or vertical position, to a more horizontal position, for example, this alters the center of gravity of the entire light bar 14 and causes light bar 14 to rotate and tilt about its longitudinal axis towards a forward position. In such a case, mercury switch 76 would close applying 12 volts DC to induction coil 108 of relay 109. This applies 12 volts DC simultaneously to both leveling actuators 38 to make the necessary corrections to regain the level position of light bar 14. Once this level position is regained, mercury switch 76 goes open, and no further movement of actuators 38 occurs.

Conversely, when one or more of lighting fixtures 12 is repositioned to a more downwardly tilted or more vertical orientation, reverse rotation is applied to bar 14 closing mercury switch 78. This applies 12 volts DC to induction coil 110 of relay 107, applying 12 volts DC of an opposite polarity to both leveling actuators 38.

In the preferred embodiment, linear actuators 38 can be six-inch stroke linear actuators available from Warner Electric under product designation no. S12-17A8-06. Relays 107 and 109 are available from Mid Tex under product designation no. 158-22B200. Mercury switches 76 and 78 are available from Comus under product designation no. CB17-SO and can be utilized with matched mounting clips available from Comus under product designation no. 3BH. Multi-pin connectors 100 and 102 can be integrated into one unit which is available from Molex under product designation 03-09-2092.

It is to be understood that in the preferred embodiment, leveling plate 98 with attendant circuitry can be inserted into the interior of light bar 14, near one end to protect it from the elements and other risk of damage. The placement of mercury switches 76 and 78 can thus be done in the factory before insertion into bar 14. Precalibration and other fine tuning can also be done.

It can therefore be seen that the invention achieves at least all of its stated objectives. It is to be understood, and appreciated, that the present invention can take many forms and embodiments. The true essence and spirit of this invention are defined in the appended claims and it is not intended that the embodiment of the invention presented herein should limit the scope thereof.

For example, any number of light fixtures 12 can be mounted to light bar 14. Additionally, light bar 14 can take many different shapes and configurations. Additionally, any number of brackets 30 and actuators 38 can be utilized.

Furthermore, it is to be understood that various types of detector units 44 can be used. Alternatively, invention 10 could be operated semi-automatically by manually determining what position the support member and lighting fixtures should be to be level, and then operating actuator members 38 to achieve that position.

It is also to be understood that the invention 10 could operate by different types of suspension cables or means, from different types of elevated structures; such as ceiling beams, cranes, booms, or derricks. Additionally, horizontal support cables could be utilized as the elevated structure 24.

What is claimed is:

1. A leveling means for maintaining or adjusting the orientation of a support member suspended from a suspension means having a longitudinal axis which is generally horizontally positioned, and to which is mounted one or more light fixtures, comprising:

a bracket means attached to the support member and having a distal end extended outwardly from the support member;

a pulley means attached to the suspension means;

a cable means attached at one opposite end to the distal end of the bracket means, and extending through the pulley means to the support member at its other opposite end; and an extendable and retractable actuator means attached at opposite ends between generally the distal end of the bracket means and the pulley means.

2. The means of claim 1 further comprising a detector means for detecting misalignment from a desired position of the support member.

3. The means of claim 2 wherein the detector unit further comprises signal means for causing extension or retraction of the actuator means depending on misalignment of the support member.

4. A leveling system for a support member which is suspended from an elevated means by at least one cable means, and to which is mounted one or more light fixtures comprising:

at least one leveling means connected between the cable means and the support member, each leveling means including a bracket means having a first end secured to the support member, and a second end extended outwardly from the support member, and a second cable means pivotally attached at opposite ends to the first and second ends of the bracket means;

a pulley means pivotally connected to the cable means extending downwardly from the elevated member, including a rotatable pulley wheel over which is positioned the second cable means;

an actuator means connected at opposite ends between the second end of the bracket means and the pulley means, and upon actuation, the actuator means altering the linear displacement of opposite ends of the actuator means from one another; and so that actuation of the actuator will cause lengths of first and second segments of the second cable means between the second end and the pulley and the pulley and the first end to change.

5. A leveling means for adjusting the orientation of a suspended support member having a longitudinal axis which is generally horizontally positioned and to which is mounted one or more light fixtures comprising:

a pulley means secured to the lower end of a suspended cable;

an arm means extending from the support member;

a cable connected at opposite ends to the support means and to the arm at a position spaced apart from the support means, the cable also passing through the pulley means;

extendable means connected at opposite ends between the pulley and the arm; and detector means for detecting the position of the support member and detecting misalignment from a desired position.

* * * * *